US006024036A

United States Patent [19]

Miyachi et al.

[11] Patent Number: 6,024,036

[45] Date of Patent: Feb. 15, 2000

[54] SEWING MACHINE FOR AUTOMATICALLY HEMMING GARMENTS

[75] Inventors: Nobuji Miyachi; Kouji Miyachi, both of Kyoto, Japan

[73] Assignee: Hams Corporation, Kyoto, Japan

[21] Appl. No.: 09/190,233

[22] Filed: Nov. 13, 1998

[30] Foreign Application Priority Data

Nov. 17, 1997 [JP] Japan ..... 9-356008

[51] Int. Cl.[7] ..... D05B 21/00; D05B 27/12; D05B 35/02

[52] U.S. Cl. ..... 112/470.01; 112/141; 112/322

[58] Field of Search ..... 112/470.01, 470.07, 112/318, 322, 141, 142, 143, 220, 470.03, 306

[56] References Cited

U.S. PATENT DOCUMENTS 4,473,017 9/1984 Letard et al. .
4,541,347 9/1985 Kawaguchi et al. ..... 112/470.03
4,665,848 5/1987 Michaels et al. .
5,370,072 12/1994 Adamski, Jr. ..... 112/306 X
5,642,681 7/1997 Adamski, Jr. et al. ..... 112/470.07
5,687,660 11/1997 Honda et al. ..... 112/470.07
5,899,159 5/1999 Dasher et al. ..... 112/306 X

FOREIGN PATENT DOCUMENTS 3-78 11/1988 Japan .

*Primary Examiner*—Peter Nerbun
*Attorney, Agent, or Firm*—Greenblum & Bernstein, P.L.C.

[57] ABSTRACT

A sewing machine for automatically hemming garments includes an arm shaft for driving a sewing needle up and down, upper and lower feed rollers disposed by the sewing needle for moving a hem of a garment under pressure, and first and second drive motors for driving the upper and lower feed rollers, respectively, independently of the arm shaft.

3 Claims, 7 Drawing Sheets

SEWING MACHINE FOR AUTOMATICALLY HEMMING GARMENTS

BACKGROUND OF THE INVENTION

1. Field of the Invention

The present invention relates to a sewing machine for automatically forming a double hem on free ends of garments that are circular or tubular in shape and for automatically stitching double folded portions of the garments.

2. Description of the Related Art

Japanese Patent No. 1640300 (Japanese Patent Publication No. 3-78) discloses a sewing machine for hemming double folded free ends of trousers, as shown in FIG. 14.

In this sewing machine 22*a*, prior to sewing, an inwardly folded generally tubular hem 60, indicated by a dotted line in FIG. 14, is turned over a lower feed roller 40 and a hem rotating roller 47*a* under tension, and is engaged at its inner peripheral surface with a folding guide 45. When the hem rotating roller 47*a* is rotated in the counterclockwise direction to move the hem 60 in a direction shown by an arrow Q, the hem 60 is double folded by the folding guide 45. Thereafter, as shown in FIG. 15, an upper feed roller 30 and a presser foot 28 are lowered to press the material of the hem 60 against a lower feed roller 40, and a sewing needle 27 is moved up and down by driving an upper or arm shaft (not shown). Accordingly, when the upper and lower feed rollers 30 and 40 are rotated in the directions shown by arrows N and S, respectively, that portion of the hem 60 which is sandwiched between the upper and lower feed rollers 30 and 40 is moved leftward, i.e., in the direction of the arrow Q, resulting in sewing of the double folded portion of the hem 60.

In this sewing machine 22*a*, however, when the double folded hem is formed prior to sewing, the folding guide 45 is positioned on the slack side of the hem rotating roller 47*a* that has moved to a tensioning position as shown by a solid line in FIG. 14. Because of this, it is likely that slackening occurs on the material of that portion of the hem 60 which is being moved from the hem rotating roller 47*a* toward the folding guide 45. As a result, the length of the hem folded by the folding guide 45 varies and, in some cases, does not fall within a desired range.

To overcome this problem, a freely rotatable hem guide roller 47 as shown in FIG. 8 is used, in place of the hem rotating roller 47*a*, together with upper and lower feed rollers 30 and 40 of a feed roller mechanism 57 shown in FIG. 5. As shown in FIG. 8, sandwiched between the upper and lower feed rollers 30 and 40 under pressure, the material of the hem 60 shown by a dotted line is moved in a direction shown by an arrow Q. In this case, the folding guide 45 is positioned on the light side with respect to the direction of rotation of the hem 60.

In the improved type above, the upper feed roller 30 is connected, via a flexible shaft 32, an upper feed shaft 33, a second gear 35, a first gear 34, and a one-way clutch 36, to a feed roller drive shaft 37 that rotates in synchronization with an arm shaft 25 for vertically moving a sewing needle 27, while the lower feed roller 40 is connected to the upper feed shaft 33 via a lower feed shaft 41, a fourth gear 43, and a third gear 42.

The third and fourth gears 42 and 43 are in mesh with each other so that the upper and lower feed rollers 30 and 40 may have the same circumferential speed. These rollers 30 and 40 are controlled by the first and second gears 34 and 35 so as to rotate at respective desired speeds. The rollers 30 and 40 are also rotated by a hem rotating motor 50 with a brake, independently of the rotation of the arm shaft 25, to first form a double fold of the hem prior to sewing.

The motor 50 has an output shaft 51 on which a sprocket 53 is mounted via a one-way clutch 52. The sprocket 53 is connected, via a chain 55, to another sprocket 54 fixedly mounted on the third gear 42. When the motor 50 rotates in a direction shown by an arrow in FIG. 6, the one-way clutch 52 acts to rotate the upper and lower feed rollers 30 and 40 via the chain 55 and the third gear 42.

More specifically, under the condition in which the inwardly single folded tubular hem 60 has been stretched under tension by the hem guide roller 47 from inside, as shown by a single-dotted chain line in FIG. 8, the folding guide 45 is moved towards an inner free end 61 of the hem 60 to roll it inwardly. The upper feed roller 30 is then lowered to press the hem 60 against the lower feed roller 40, and the motor 50 with the brake is activated to rotate the upper and lower feed rollers 30 and 40 in the directions of the arrows N and S, respectively, thereby moving the hem 60 in the direction of the arrow Q in FIG. 8 (the direction shown by an arrow in FIG. 9). As a result, a double fold 65 is first formed on the hem 60 and is subsequently transferred to a stitching area immediately below the sewing needle 27.

It is to be noted here that when the motor 50 with the brake is rotating, the first gear 34 runs idle with respect to the feed roller drive shaft 37 by the action of the one-way clutch 36.

The feed roller mechanism 57 referred to above, however, has the following drawbacks.

(a) After the hem 60 has been stretched by the hem guide roller 47 from inside, as shown in FIG. 8, and the folding guide 45 has been moved towards the inner free end 61 of the hem to roll it up, as shown in FIG. 10, the material of the hem 60 is sandwiched under pressure between and transferred by the upper and lower feed rollers 30 and 40, which are mutually connected via the third and fourth gears 42 and 43 at a fixed gear ratio, so that the double fold 65 may be formed on the hem 60, as shown in FIG. 13. Because the inner material 61 of the hem 60 is transferred under the condition in which it has received a resisting force greater than that received by the outer material 62 of the hem 60 by the folding action of the folding guide 45, the length of travel of the inner material 61 becomes shorter than that of the outer material 62, causing slackening on the inner material 61. Accordingly, when the sewing of the double folded portion of the hem 60 has been completed by rotating the hem 60 more than one revolution, the hem 60 is sometimes wrinkled or twisted.

To overcome this problem, the circumferential speeds of the upper and lower feed rollers 30 and 40 can be differentiated by changing the diameters thereof. In other words, if slackening occurs on the inner material 61, it is sufficient if the circumferential speed of the lower feed roller 40 is increased by enlarging the lower feed roller 40 in diameter relative to the upper feed roller 30. The degree of slackening on the inner material 61, however, differs according to the manner of weaving, flexibility, thickness, hardness and the like. To cope with differences in slackening, it is necessary to prepare a variety of lower feed rollers having different diameters, select an appropriate one of a diameter to remove slackening, and exchange them. This work is troublesome and time-consuming, and lowers the efficiency.

Furthermore, it is impossible to change the circumferential speed of the lower feed roller 40 during one round of the hem 60.

(b) Because the upper and lower feed rollers 30 and 40 are rotated via the first and second gears 34 and 35 by the feed roller drive shaft 37 that rotates together with the arm shaft 25, the gear ratio of the first and second gears 34 and 35 must be changed to change the pitch of seams. This requires a troublesome work to exchange the first and second gears 34 and 35.

SUMMARY OF THE INVENTION

The present invention has been developed to overcome the above-described disadvantages.

It is accordingly an objective of the present invention to provide an improved sewing machine for automatically hemming garments, which is capable of moving a double folded free end of generally tubular portions of the garments towards a stitching area under the condition in which an inner material and an outer material are transferred in synchronization with each other.

In accomplishing the above and other objectives, a sewing machine according to the present invention includes an arm shaft for driving a sewing needle up and down, upper and lower feed rollers disposed by the sewing needle for moving a hem of a garment under pressure, a first drive motor for driving the upper feed roller independently of the arm shaft, and a second drive motor for driving the lower feed roller independently of the arm shaft.

This construction can freely change the amount of rotation of the upper and lower feed rollers depending on the material of the garments, allowing the outer and inner materials to be transferred in synchronization with each other for subsequent stitching.

Conveniently, each of the first and second drive motors is a servomotor or a pulse motor.

The sewing machine may further include an upper feed shaft connected to the upper feed roller and also to the first drive motor via a first timing belt, a first gear mounted on the upper feed shaft so as to be freely rotatable relative thereto, a timing pulley secured to the first gear for rotation together therewith, a lower feed shaft connected to the lower feed roller, and a second gear secured to the lower feed shaft. In this case, the first and second gears are in mesh with each other so that rotation of the second drive motor may be transmitted to the lower feed roller via a second timing belt, the timing pulley and the first and second gears.

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

This application is based on application No. 9-356008 filed Nov. 17, 1997 in Japan, the content of which is incorporated hereinto by reference.

Figure 1:
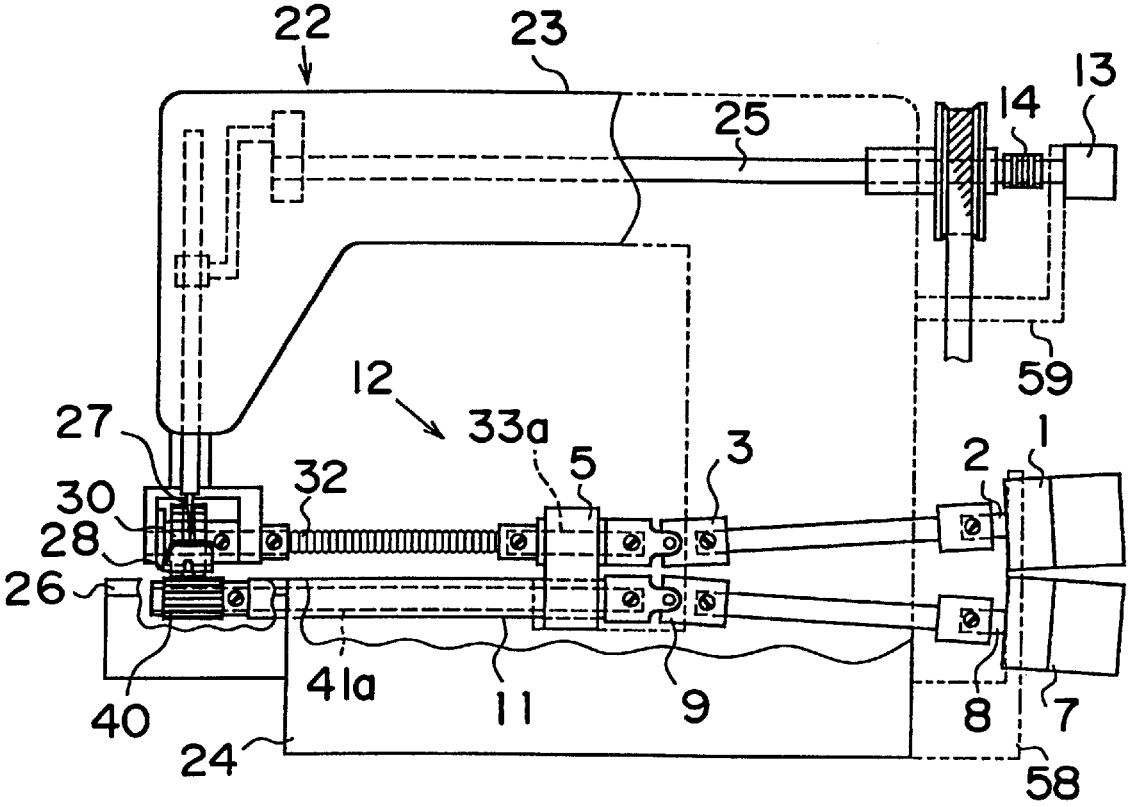
FIG. 1 is a vertical elevational view of a sewing machine according to the present invention.

Referring now to the drawings, there is shown in FIG. 1 a sewing machine 22 embodying the present invention for automatically forming a double fold on free ends of tubular portions of garments and subsequently hemming the double folded portion of the tubular portions.

Figure 2:
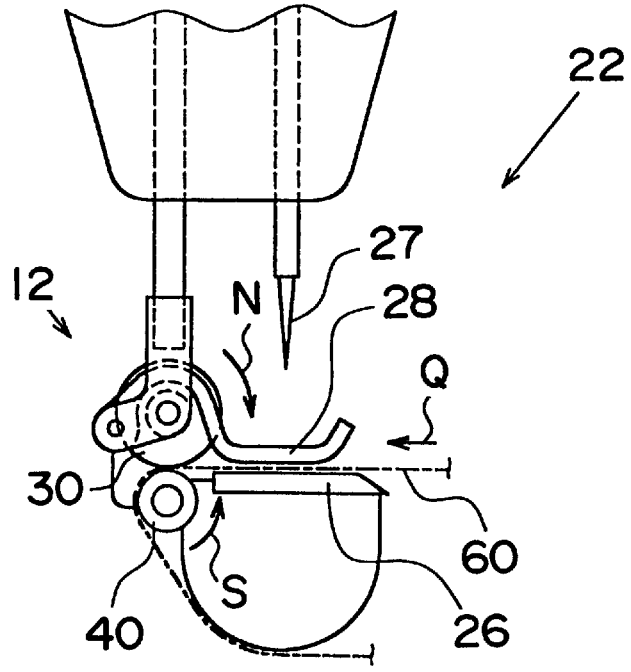
FIG. 2 is a side view of the sewing machine of FIG. 1.

This sewing machine 22 has a feed roller mechanism 12 including upper and lower feed rollers 30 and 40 that are much the same as the conventional ones. As viewed in FIG. 2, the upper feed roller 30 is disposed on the left-hand side of a sewing needle 27 so as to be vertically movable, while the lower feed roller 40 is disposed on the left-hand side of a needle plate 26. The material of a hem 60 of garments such as, for example, trousers, as shown by a single-dotted chain line, is moved in a direction shown by an arrow Q by rotating the upper and lower feed rollers 30 and 40 in directions shown by arrows N and S, respectively.

The upper feed roller 30 is connected, via a flexible shaft 32, to a front end of an upper feed shaft 33*a* that is journaled in an upper portion of a block bearing 5 fixedly mounted on a machine bed 24 at a central portion thereof. A rear end of the upper feed shaft 33*a* is connected, via a universal joint 3, to an output shaft 2 of an upper servomotor 1 that is secured to a rear portion of the sewing machine 22 via a support bracket 58 shown by a double-dotted chain line in FIG. 1.

The lower feed roller 40 is connected to a front end of a lower feed shaft 41*a* journaled in a generally cylindrical bearing 11 fixedly mounted on the machine bed 24 at the central portion thereof. A rear end of the lower feed shaft 41*a* is connected, via a universal joint 9, to an output shaft 8 of a lower servomotor 7 that is secured to the rear portion of the sewing machine 22 via the support bracket 58.

Figure 3:
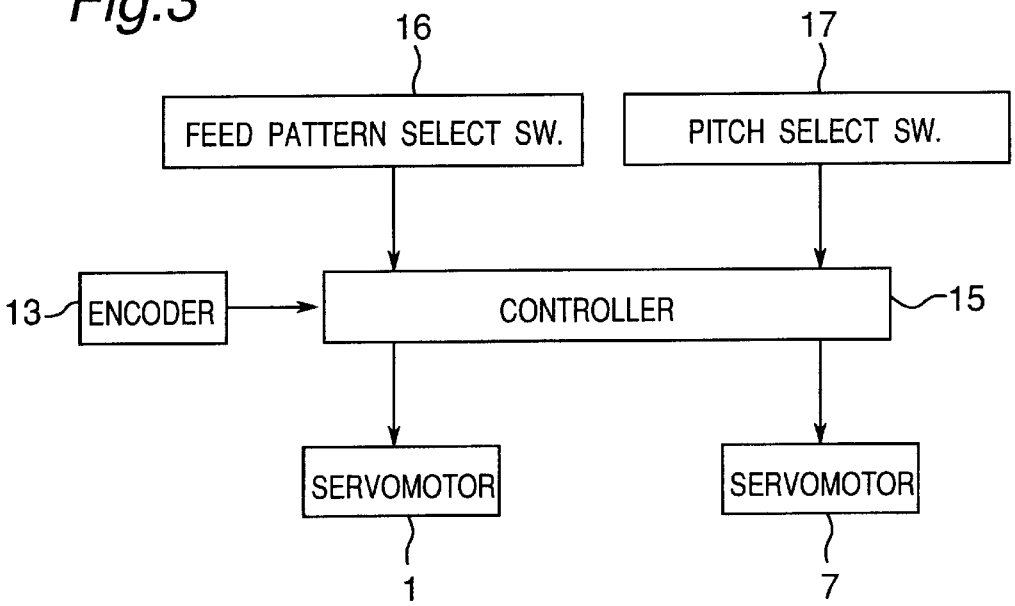
FIG. 3 is a block diagram of a control circuit for controlling the sewing machine of FIG. 1.

The sewing machine 22 is provided with an encoder 13 mounted on a rear portion of a machine arm 23 via a support member 59 shown by a double-dotted chain line. The encoder 13 is connected to a rear end of a horizontally extending arm shaft 25 via a joint 14 and detects the displacement in rotational angle of the arm shaft 25, thereby detecting the displacement in vertical position of the sewing needle 27. The encoder 13 sends a detection signal to a controller 15 electrically connected thereto, as shown in FIG. 3.

Upon receipt of the detection signal from the encoder 13, the controller 15 inputs it to the upper and lower servomotors 1 and 7 of the feed roller mechanism 12 to control them. The controller 15 is also electrically connected to a feed pattern selector switch 16 and to a seam pitch selector switch 17.

In the practice of the present invention, the lengths of transfer of the inwardly folded portion 61 and the outer portion 62 of the hem 60 can be changed depending on the properties (particularly the flexibility) peculiar to the materials of garments or clothes. The feed pattern selector switch 16 appropriately determines the amount of rotation (rotational angle) of the upper and lower feed rollers 30 and 40 to change the lengths of transfer of the inner and outer portions of the hem 60 depending on the material thereof. To this end, a plurality of data collected in association with the appropriate amount of rotation of the upper and lower feed rollers 30 and 40 are programmed in the controller 15 in advance. The data are numbered and can be read out from the controllers 15 using respective numbers. Prior to sewing, the number of the data corresponding to the material of the hem 60 to be sewn is set using the feed pattern selector switch 16 so that the controller 15 may control the upper and lower servomotors 1 and 7 according to the program indicative of the amount of rotation of the selected number.

On the other hand, the seam pitch selector switch 17 is a switch to change the pitch of seams. In order to change the pitch of seams by changing the amount of rotation (rotational angle) of the upper and lower feed rollers 30 and 40, a plurality of data indicative of different pitches are programmed in the controller 15 in advance. The data are numbered and can be read out from the controllers 15 using respective numbers. Prior to sewing, the number of the data corresponding to a desired pitch of seams is set using the seam pitch selector switch 17 so that the controller 15 may control the upper and lower servomotors 1 and 7 according to the program indicative of the pitch of seams of the selected number.

Figure 4:
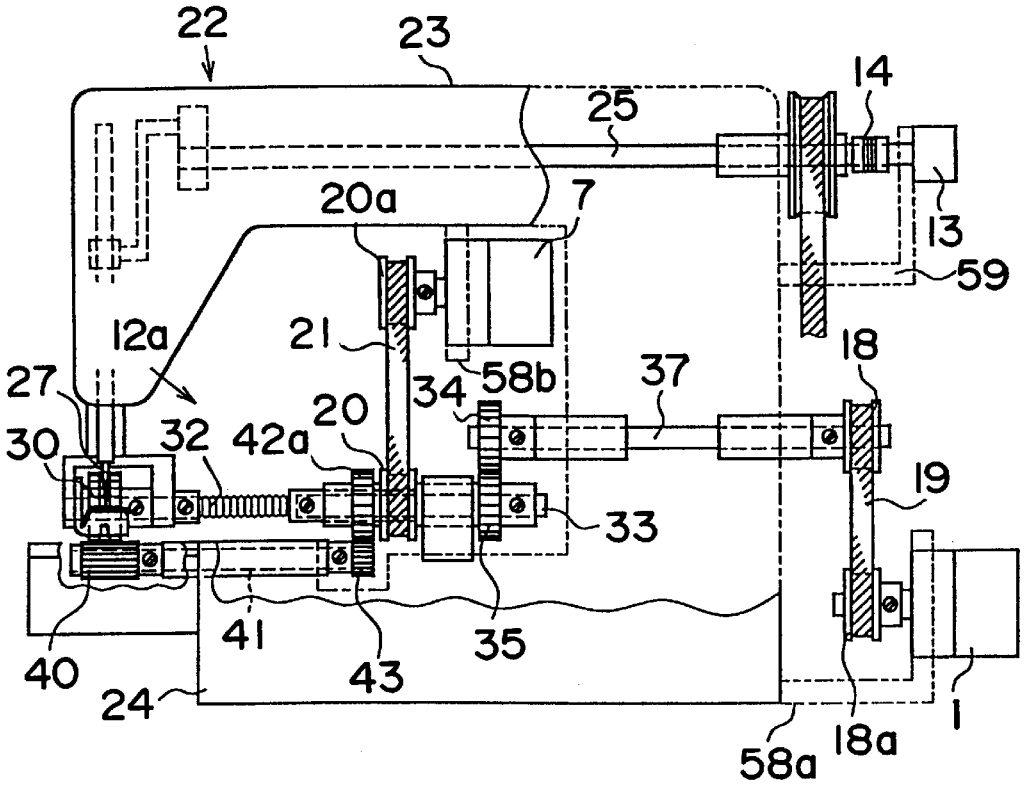
FIG. 4 is a view similar to FIG. 1, but depicting a modification thereof.
Figure 5:
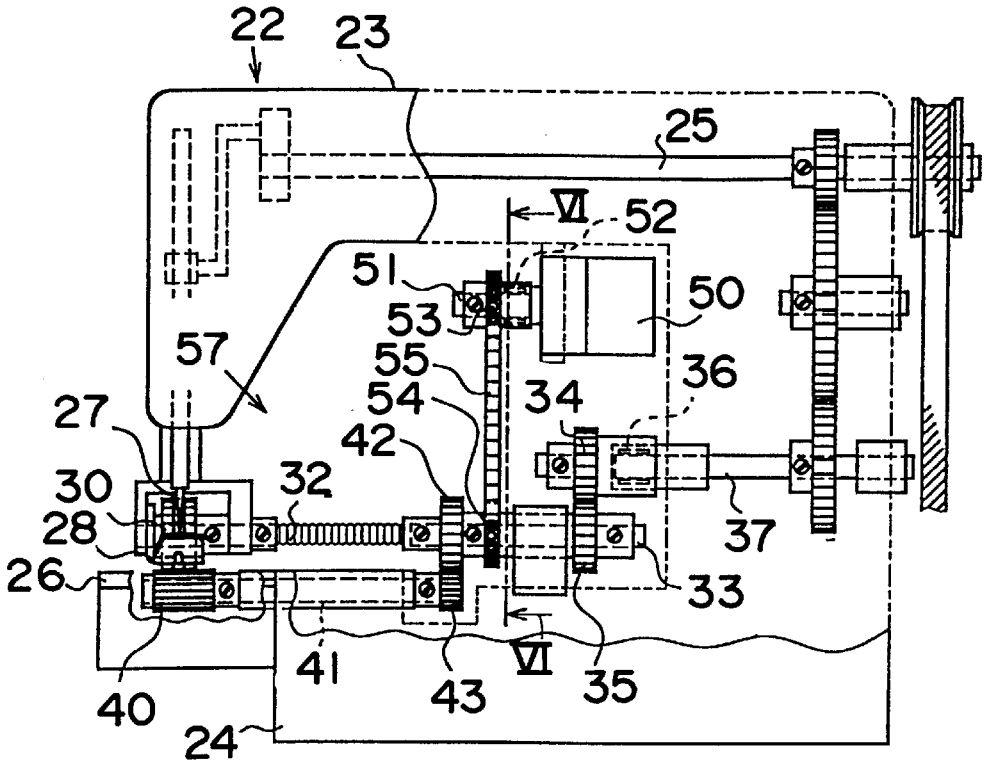
Fig. 5 PRIOR ART
FIG. 5 is a view similar to FIG. 1, but depicting a conventional sewing machine.
Figure 6:
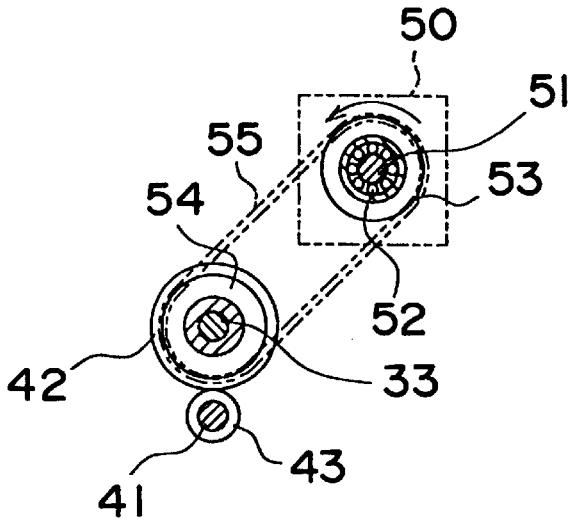
Fig. 6 PRIOR ART
FIG. 6 is a cross-sectional view taken along line VI—VI in FIG. 5.

It is to be noted here that although in the above-described embodiment the upper and lower feed rollers 30 and 40 have been described as being independently driven by the two servomotors 1 and 7, respectively, a feed roller mechanism 12*a* as shown in FIG. 4 may be employed in which the feed roller drive shaft 37, the third gear 42 and the like, shown in FIG. 5, are utilized.

More specifically, In this feed roller mechanism 12*a*, the feed roller drive shaft 37 uncoupled from the arm shaft 25 has a timing pulley 18 mounted thereon at a rear end thereof so that rotation of the servomotor 1 mounted on a rear portion of the sewing machine 22 via a support bracket 58*a* may be transmitted to the timing pulley 18 via a timing pulley 18*a* and a timing belt 19. The third gear 42*a* and a timing pulley 20 disposed adjacent the third gear 42*a* and secured thereto are mounted on the upper feed shaft 33 so as to be freely rotatable relative thereto. Rotation of the servomotor 7 mounted on the sewing machine 22 on the left-hand side thereof via a support bracket 58*b* is transmitted to the timing pulley 20 via a timing pulley 20*a* and a timing belt 21. By this construction, each of the upper and lower feed rollers 30 and 40 is rotated independently of the rotation of the arm shaft 25.

With the construction of FIG. 4, the upper and lower feed rollers 30 and 40 can be independently controlled by the two servomotors 1 and 7, respectively, without appreciably changing the basic construction of the conventional sewing machine.

It is also to be noted that although in the above-described embodiment the servomotors 1 and 7 are employed as the drive motors, pulse motors can be used in place of the servomotors 1 and 7.

The sewing machine 22 referred to above is microcomputer-controlled or sequentially controlled.

The sewing machine 22 operates as follows.

At the outset, an operator sets the feed pattern selector switch 16 to an appropriate number to call data indicating a desired amount of rotation of each of the upper and lower feed rollers 30 and 40 corresponding to the material of a hem 60 to be sewn. The operator likewise sets the seam pitch selector switch 17 to an appropriate number to call data indicating a desired pitch of seams.

Figure 7:
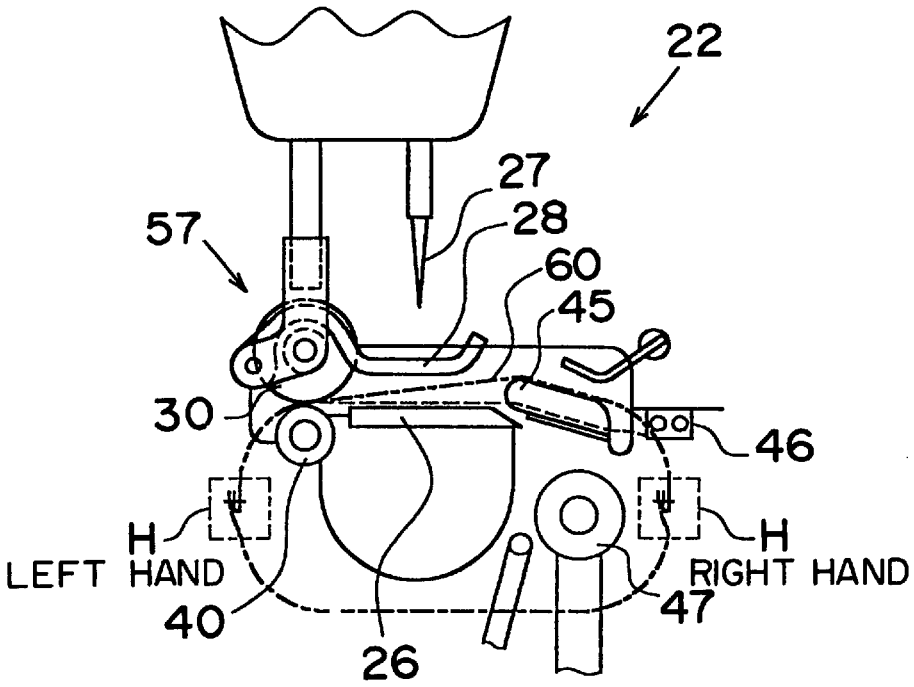
FIG. 7 is a side view of the sewing machine of FIG. 1, depicting the condition prior to folding and stitching of a hem of a garment.

Thereafter, the operator folds a free end of the hem 60 inwardly, holds respective sides of the hem 60 with both hands H, H, as shown by double-dotted chain lines in FIG. 7, and sets the hem 60 on the sewing machine 22 so that all the lower feed roller 40, the needle plate 26, the folding guide 45, and the hem guide roller 47 may be inserted into the hem 60, as shown by a single-dotted chain line. The operator then turns a foot start switch on.

When both hands H, H are withdrawn from the hem 60, a photoelectric sensor 46 for starting use disposed near the folding guide 45 senses the behavior of the right hand H, thereby starting automatic operation of the sewing machine 22.

Figure 8:
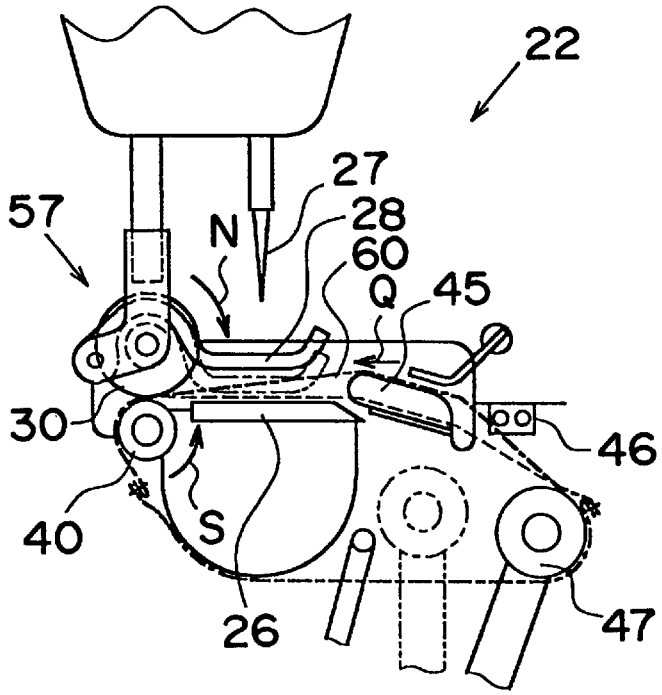
FIG. 8 is a view similar to FIG. 7, but depicting the condition during folding and stitching of the hem.
Figure 9:
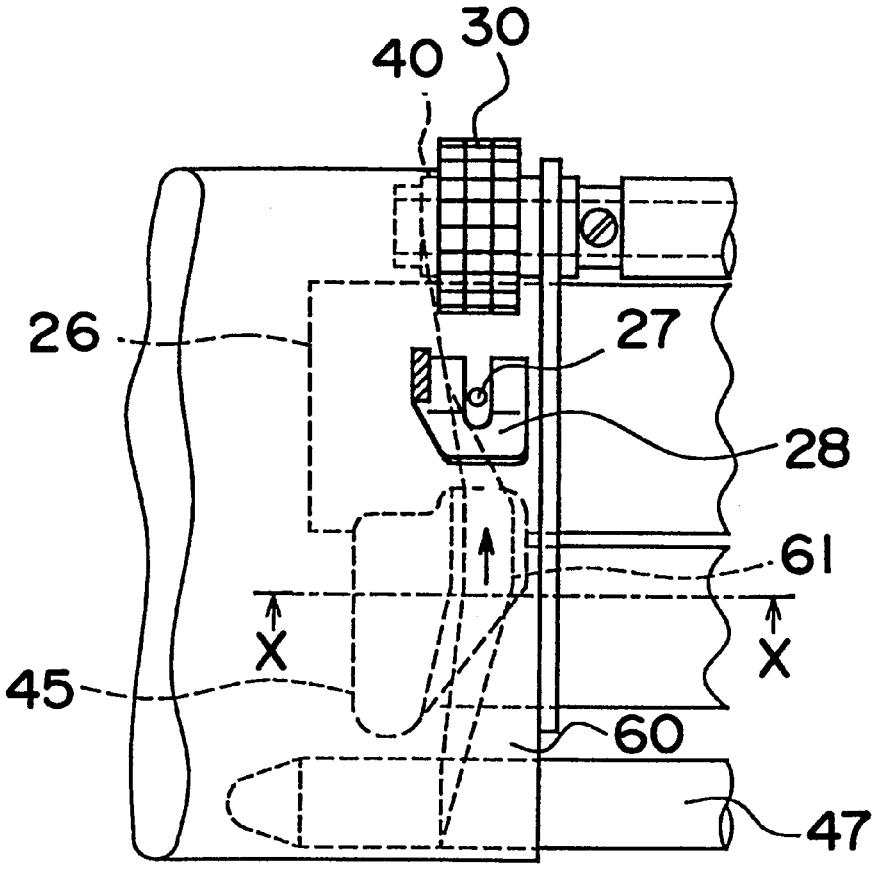
FIG. 9 is a top plan view of folding and stitching areas when a double hem is being formed.
Figure 10:
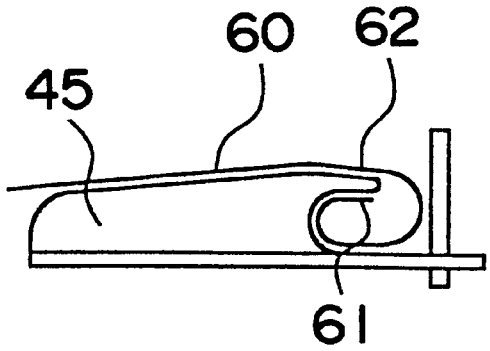
FIG. 10 is a cross-sectional view taken along line X—X in FIG. 9.

When the hem guide roller 47 is moved rightwards to stretch the hem 60 from inside, as shown by a single-dotted chain line in FIG. 8, the folding guide 45 is moved rearwards to roll the inwardly folded portion 61 of the hem 60 inwardly, as shown in FIGS. 9 and 10.

Figure 11:
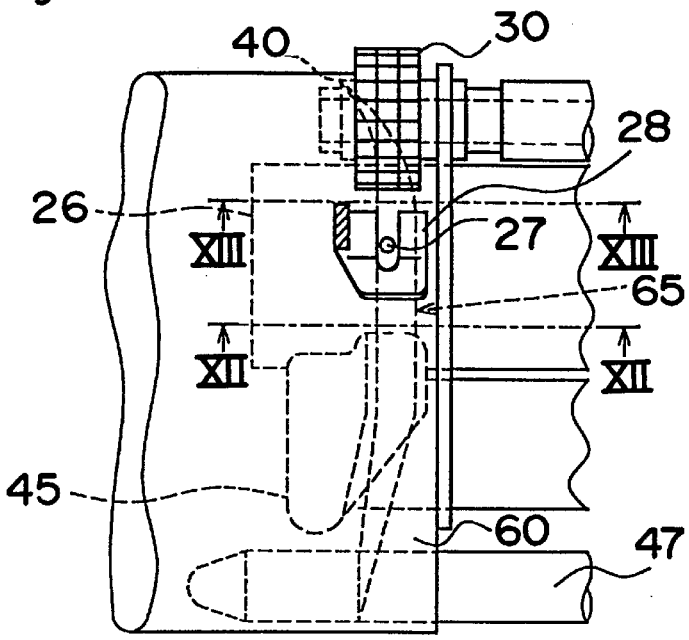
FIG. 11 is a view similar to FIG. 9, but depicting the condition in which a double folded portion of the hem has been transferred to the stitching area.
Figure 12:
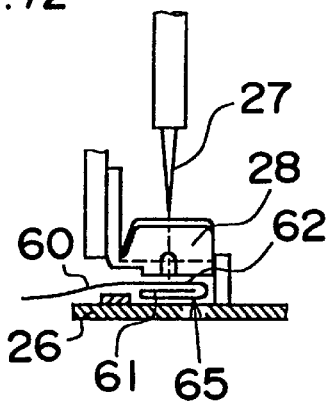
FIG. 12 is a cross-sectional view taken along line XII—XII in FIG. 11.
Figure 13:
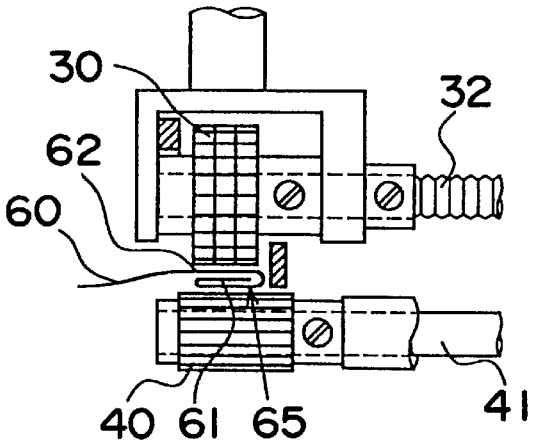
FIG. 13 is a cross-sectional view taken along line XIII—XIII in FIG. 11.
Figure 14:
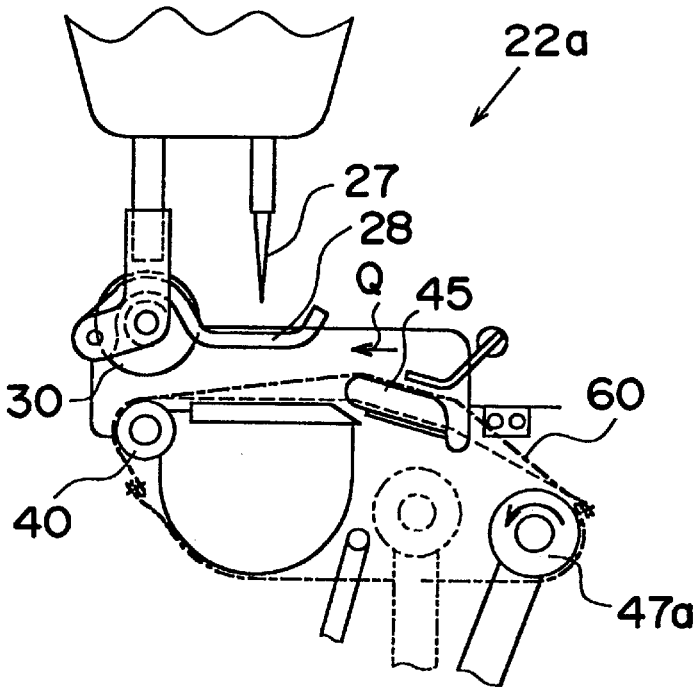
Fig. 14 PRIOR ART
FIG. 14 is a side view of a conventional sewing machine when the double folded portion of the hem is being formed.
Figure 15:
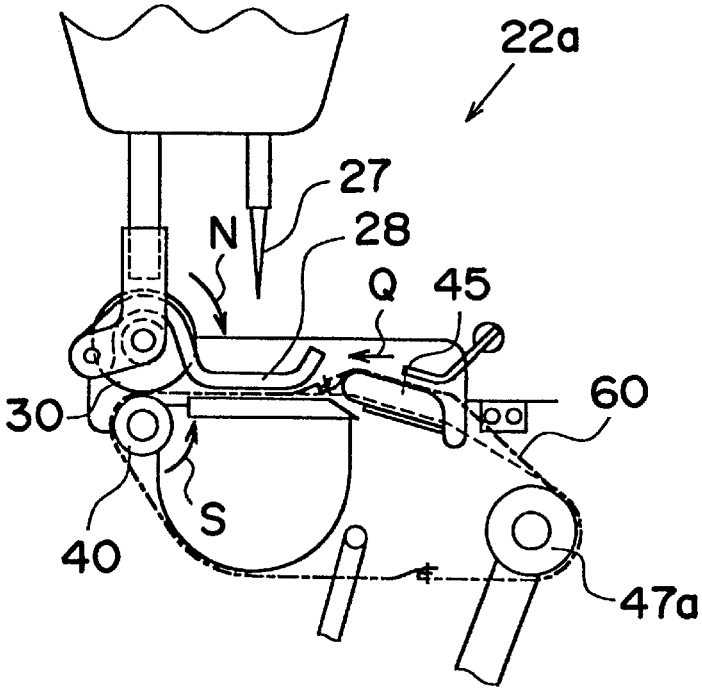
Fig. 15 PRIOR ART
FIG. 15 is a view similar to FIG. 14, but depicting the condition in which the double folded portion of the hem is being stitched.

Thereafter, the upper feed roller 30 is lowered to press the hem 60 against the lower feed roller 40, as shown in FIG. 8. Then, the upper and lower servomotors 1 and 7 rotate in the directions shown by the arrows N and S, respectively, in accordance with a program of the number set by the feed pattern selector switch 16, thereby moving the hem 60 leftwards (the direction of the arrow Q) under pressure. As a result, a double fold 65 is steadily formed on the hem 60, as shown in FIGS. 11 and 12.

When the presser foot 28 is lowered to press the double folded portion 65 of the hem 60 downwards, as shown by a double-dotted chain line in FIG. 8, the sewing needle 27 is moved up and down by the arm shaft 25. At the same time, the upper and lower feed rollers 30 and 40 are rotated in the directions of the arrows N and S, respectively, in accordance with the program of the number set by the feed pattern selector switch 16 and that of the number set by the seam pitch selector switch 17, thereby moving the hem 60 leftwards (the direction of the arrow Q).

The vertical movement of the sewing needle 27 and the transfer of the hem 60 are continued so that the double folded portion 65 of the hem 60 may be continuously stitched at a desired pitch.

The folding guide 45 is then returned forwards to move away from the inner material 61 of the hem 60 at a location slightly (about 6 centimeters) before one rotation of the hem 60 is completed. When the sewing needle 27 is stopped at a location slightly (about 3 centimeters) after one rotation of the hem 60 has been completed, a sewing yarn is severed and both the presser foot 28 and the upper feed roller 30 are lifted.

Thereafter, when the hem guide roller 47 is moved leftwards to release the hem 60 from the tight condition, a hem-removing member (not shown) is activated to withdraw the hem 60 from the needle plate 26 and the folding guide 45 for removal of the hem 60 from the sewing machine 22.

The operator then folds a free end of another hem inwardly and sets it on the sewing machine 22. Upon withdrawal of both hands H, H from the hem, the double folded portion of the hem is stitched by the sewing machine 22 by repeating the above-described operations.

As is clear from the above, according to the present invention, by setting an appropriate number to the feed pattern selector switch 16 depending on the properties, particularly the flexibility, of a garment to be sewn, the controller 15 controls, upon receipt of a signal from the feed pattern selector switch 16, the two servomotors 1 and 7 independently so that the upper and lower feed rollers 30 and 40 may be rotated at respective speeds proper for the properties of the garment.

Accordingly, the inwardly folded portion 61 and the outer portion 62 of the hem 60 are transferred towards the stitching area in synchronization with each other and, hence, no slackening occurs on the inwardly folded portion 61, enabling accurate folding with a substantially constant size and resulting in nice-looking high-quality stitching of the three thicknesses of the hem.

Moreover, according to the present invention, by setting an appropriate number to the seam pitch selector switch 17, the controller 15 controls, upon receipt of a signal from the seam pitch selector switch 17, the two servomotors 1 and 7 to change the pitch of seams. Accordingly, unlike the conventional sewing machine, no gear exchange is required to change the pitch of seams, thus considerably reducing costs.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A sewing machine for automatically hemming garments, comprising:

an arm shaft that drives a sewing needle up and down;

upper and lower feed rollers disposed adjacent to said sewing needle, said upper and lower feed rollers moving a hem of a garment under pressure;

a first drive roller that drives said upper feed roller mechanically independently of said arm shaft;

a second drive roller that drives said lower feed roller mechanically independently of said arm shaft; and an upper feed shaft connected to said upper feed roller and connected to said first drive motor via a first timing belt, a first gear mounted on said upper feed belt so as to be freely rotatable relative to said upper feed shaft, a timing pulley secured to said first gear for rotation together with said first gear, a lower feed shaft connected to said lower feed roller, and a second gear secured to said lower feed shaft, said first and second gears being in mesh with each other so that rotation of said second drive motor is transmitted to said lower feed roller via a second timing belt, said timing pulley and said first and second gears.

2. The sewing machine according to claim 1, wherein each of said first and second drive motors comprises a servomotor.

3. The sewing machine according to claim 1, wherein each of said first and second drive motors comprises a pulse motor.

* * * * *